US005242297A

United States Patent [19]

Cirami

[11] Patent Number: 5,242,297

[45] Date of Patent: Sep. 7, 1993

[54] CHILD-RESISTANT LIGHTER

[76] Inventor: Salvatore Cirami, 12-21 35th Ave., Apt. 4F, Long Island City, N.Y. 11106

[21] Appl. No.: 942,629

[22] Filed: Sep. 9, 1992

Related U.S. Application Data

[63] Continuation-in-part of Ser. No. 780,245, Oct. 22, 1991, abandoned.

[51] Int. Cl.[5] ..... F23D 11/36

[52] U.S. Cl. ..... 431/153; 431/277; 222/153

[58] Field of Search ..... 431/153, 277, 267, 344; 222/153, 402.11; 251/95, 102, 103, 106, 111, 115, 116; 267/158

[56] References Cited

U.S. PATENT DOCUMENTS

| | | | |
|---|---|---|---|
| 4,830,603 | 5/1989 | Cirami | 431/153 |
| 4,832,596 | 5/1989 | Morris, Sr. | 431/153 |
| 5,002,482 | 3/1991 | Fairbanks et al. | 431/277 |
| 5,074,781 | 12/1991 | Fujita | 431/153 |
| 5,090,893 | 2/1992 | Floriot | 431/153 |
| 5,125,829 | 6/1992 | McDonough et al. | 431/277 X |
| 5,765,886 | 11/1992 | Frigiere | 431/153 X |

*Primary Examiner*—Carl D. Price

[57] ABSTRACT

A disposable lighter includes a pushbutton depressible toward a top wall of the lighter's upper end portion to operate a normally closed valve to an open position that releases fuel for ignition by sparks generated by rolling a flintwheel. A spring is added having a U-shaped first portion mounted in a recess in the lighter's upper end portion under the pushbutton. A second portion of the spring extends from a resilient first arm of the first portion and defines a stop member slidably mounted on the top wall under a peg depending from the pushbutton. An actuator part of the second portion projects outwardly of the upper end portion and is pushable inwardly to slide the stop member from an initial position that blocks depression of the pushbutton whereby the valve normally cannot be operated to its open position, to an alternate position wherein an opening in the stop member permits depression of the pushbutton by entry of the peg into such opening. The actuator pushes the stop member against the resistance of the first arm whereby the stop member and actuator are biased to return to their initial position. A first-portion second arm preferably carries a third arm a resilient free end of which holds the stop member at its alternate position until the pushbutton is depressed. Preferably, an obstacle imposes circuitous inward movement of the actuator.

4 Claims, 4 Drawing Sheets

CHILD-RESISTANT LIGHTER

RELATED APPLICATION AND DISCLOSURE DOCUMENT DATA

This application is a C.I.P. of Ser. No. 780,245, abandoned filed Oct. 20, 1991 and includes subject matter contained in Disclosure Document No. 309806 filed May 12, 1992. Benefit of earliest filing date is claimed for common subject matter.

BACKGROUND

1. Field of the Invention

Fires are frequently started by children playing with disposable cigarette lighters. The U.S. Consumer Product Safety Commission (the "CPSC") has moved to require such lighters to be made child-resistant. A common form of disposable lighter includes a main body portion defining a fuel reservoir that contains a combustible fluid under pressure, an upper end portion mounted on the main body portion on which upper end portion a valve mechanism is mounted communicating with the fuel reservoir, and a lever pivotally mounted on the upper end portion having one end engaged with the valve mechanism and an opposite end defining a pushbutton that is normally spaced apart from but depressible by thumb toward a top wall of the upper end portion for operating the valve mechanism from a normally closed condition that prevents release of fuel to an open condition that permits release of fuel, the pushbutton being depressible against the resistance of a spring whereby the pushbutton is biased to return its normal position spaced apart from the said top wall. In a form of disposable lighter to which the present improvement is applicable, the pushbutton biasing spring is incorporated in the valve mechanism where it biases a nozzle element thereof downwardly into a valve closure position and thereby simultaneously biases the pushbutton upwardly. Depression of the pushbutton lifts the nozzle to an open position whereby fuel is released in a gaseous state. Simultaneously with depression of the pushbutton, the user rolls a flintwheel that is mounted on the lighter's upper end portion over the pivotal axis of the lever, rotation of the flintwheel abrading a flint that generates sparks that ignite the released combustible gas. When the user releases the pushbutton, the pushbutton and the nozzle element return to their respective initial positions.

It has frequently been proposed to make such a lighter child resistant by adding an element that, when in a given initial position, prevents depression of the pushbutton whereby the valve mechanism normally cannot be operated to its open position, but which element, when operated to a given alternate position permits depression of the pushbutton, and further functions such that, after depression and release of the pushbutton, the said element automatically returns the pushbutton to its normally locked condition. The invention pertains to an improvement in such means.

2. Description of Prior Art

Disposable lighters are assembled at high speed by automatically operating machinery that is specialized to handle a lighter of given external size and shape. A child-resistant lighter concept that differs so radically from the current product of a given manufacturer that it would require major alteration of existing facilities is not economically feasible. Accordingly, in order that existing facilities can be utilized, it is necessary to, in effect, convert the current lighter product into one that is child-resistant, as opposed to creating a wholly new product.

Producibility by existing facilities requires that, externally, the main body portion of the child-resistant version remain unchanged from that of the current product; i.e., modifications necessary to make the conventional product child-resistant must be confined to its upper end portion.

A further constraint is that current fuel capacity must not be reduced and this precludes the arrangement of any child-resistance-effecting structure inside the main body portion of the conventional lighter where it would reduce the volume of the fuel reservoir.

Still another consideration is that, since assembly of a disposable lighter is by machine involving machine movements that sequentially snap into place all components of the lighter at extremely high speed, the structure effecting child-resistancy must be of such nature as to lend itself to handling by such machinery for such mode of assembly.

Finally, economy is critical since the lighter is intended to be disposable.

A number of child-resistant lighters have previously been proposed but only a very few have met all of the requirements listed above.

At present, the only technical requirements mandated by the CPSC with respect to the nature of the child-resistance-effecting mechanism per se are that the lighter must be operable by an adult using only one hand (in order not to introduce a new hazard; e.g. when driving a vehicle) and that the lighter's valve-actuating pushbutton must automatically be returned to its normally locked condition after each depression and release (as opposed to requiring the user to manually reset the locking device).

Child-resistant lighters meeting these CPSC mandated requirements must also qualify under a performance test protocol involving a panel of children less than five years old, an age group determined to be most often involved in fires caused by children playing with disposable lighters, children at ages three and four having been determined to be the critical age group.

As this is written, 85% of a given panel of children must be unable to successfully operate a surrogate child-resistant lighter (emitting a signal instead of producing a flame) within a given test period. The test protocol provides for one or more demonstrations of such surrogate child-resistant lighter by the tester in order to reflect real-life situations wherein the child may observe an adult using the actual child-resistant lighter.

The *Federal Register*, Vol. 57, No. 159, Aug. 17, 1992, pages 36932–64 entitled "Proposed Safety Standard for Cigarette Lighters" (the "Standard") provides a comprehensive discourse of the development of a child-resistant lighter safety standard.

On page 36934 of the above-referenced issue of the *Federal Register* it is reported that studies "suggest that the child-resistance of currently marketed lighters is approximately 50%" and that (referring to the 85% qualification test protocol) "This constitutes at least a 70% improvement over the existing degree of child-resistance . . . "

On page 36933 of the above-referenced issue of the *Federal Register* it is stated with reference to studies of how children manipulate a disposable lighter:

"The most common method of operation by children was with two hands, using one hand to steady the lighter and the thumb or index finger of the other hand to roll the wheel and press the fuel lever."

Although children thereby have a manipulative advantage over the one-handed operation characteristic of adults, to date there is no requirement that the device relied upon in a child-resistant lighter to maintain its valve-actuating pushbutton normally locked against depression shall require prerequisite operation in more than one direction in order to render the pushbutton depressible. However, several child-resistant lighters having a locking member that need be operated in only a single direction in order to render the pushbutton depressible are known to have met or exceeded the 85% qualification test and, accordingly, are permissible to market.

Given that children in the critical age group characteristically use both hands to operate a lighter, there would appear to be nothing intrinsic in a child-resistant lighter having a "single-action" locking member that would prevent a child from either deliberately or accidentally moving the locking member, by a simple straight-line movement, into its pushbutton unlocking position, even in the case of a child-resistant lighter having a locking member that would have to be positively held in its unlocked position, since the hand that is being used to steady the lighter can be used for that purpose while the other hand presses the pushbutton. Any single-action device is subject to early defeat since children at ages three and four characteristically probe, push and pull various parts of a new toy to see what works what.

Clearly, since a single-action locking member needs to be pushed in only one direction and it will unlock the pushbutton, such a device relies wholly on the child not pushing the locking member. No parent requires proof that children ages three and four are characterized by curiosity and physical activity. Since curiosity and physical effort are all that a single-action child-resistant lighter requires of a child in order to render the pushbutton depressible, both of which qualities children in the critical age group have in abundance, a single-action device offers the lowest possible level of safety.

Approximately 500 million disposable lighters are sold each year in the United States, creating millions of opportunities each year for the correct combination of circumstances to exist wherein the child pushes the locking member in its single direction and also depresses the pushbutton (possibly also rolling the flintwheel). In light of the large numbers involved, a certain number of fatalities and serious burn injuries may occur that could have been avoided by a child-resistant lighter that required children to apply conceptual or keen observational skills--abilities not typical of children ages three and four. Of course, mere random effort, especially if the child is persistent, will, in light of such a large number of exposures each year, inevitably result in a number of defeats of any child-resistant lighter no matter how subtle or complex its mode of operation. But it seems reasonable to assume that the more that a child has to do in order to render the pushbutton depressible, the fewer the number of children that will be able to do it.

Accordingly, it would seem that a child-resistant lighter should be required to have a locking member that must necessarily be moved in at least two different directions before the pushbutton will be rendered depressible, in order to minimize the likelihood of accidental successful operation by children in the critical age group. The movement of the locking member that renders the pushbutton depressible is generally difficult to conceal. But a locking member requiring an additional movement as a prerequisite to the movement that actually unlocks the pushbutton provides an opportunity for such additional movement to be so much more subtle as not to be easily observable by children. Where such a double-action feature can be incorporated without added manufacturing expense, with the same ease of manufacture, and without significantly adding to adult inconvenience, there is little justification for not providing children such added measure of safety.

A goal of this invention is to effect child-resistance in a conventional disposable lighter product, within the context of satisfaction of all of the requirements described above pertaining to practical and economical producibility, by adding to the current lighter product only a single element that can be plugged into the suitably prepared current lighter product, and which single element is of such nature that, in preferred embodiment, it requires its actuator portion to necessarily be moved in two different directions in order to render the pushbutton depressible, but which single element, given the circumstance that the safety standard presently proposed does not mandate such a double-action mode of operation, readily lends itself to provision in alternative form not having such extra feature, in order that a manufacturer operating under benefit of the instant disclosure shall have the option, if deemed necessary or desirable in light of competitive expediency, to, at least initially, offer a product not exceeding the difficulty of operation of competing products.

Morris, Sr., U.S. Pat. No. 4,832,596, discloses a single-action device wherein a rigid stop member is mounted so as to be slidable straight under the lighter's pushbutton. In each of several embodiments the stop member has an initial position that normally blocks depression of the pushbutton and is movable, against the resistance of a distinct spring or compressible rubber piece, to an alternate position that permits depression of the pushbutton, such movement being effected by application of the index finger to an actuator portion located adjacent the front end of the lighter body (nearest where the flame is produced) and being pulled or squeezed toward the lighter body to slide a blocking portion of the stop member out of a blocking position under the pushbutton. One embodiment discloses a stop member having a portion thereof that is planar and slidable on a top wall of the lighter's upper end portion under its pushbutton, but is limited in that such planar portion is part of a considerably larger structure that is arranged externally of the lighter body. An advantage characterizing all embodiments is that the actuator portion of the pushbutton-locking structure must be positively held by the user in its pushbutton-unlocking position with the index finger of one hand while the thumb of that hand is depressing the pushbutton; i.e., nothing mechanically holds the device in its unlocked position once operated, and accordingly, such a child-resistant lighter inherently cannot be left lying about in an unlocked condition. But in all embodiments the bulkiness and arrangement of the elements is such that a child could not help but become curious, and in any event, producibility according to conventional practice would be at least difficult.

Although the accompanying drawings illustrate the preferred embodiment of the invention pushbutton-locking spring wherein the user must necessarily effect a double-action mode of operation (the actuator being then positively held in its unlocked position by mechanical means), a single-action alternative embodiment is anticipated wherein the user must manually hold the actuator at its inwardly pushed position while depressing the pushbutton; i.e., an alternative embodiment operable in the manner of the Morris, Sr. embodiments except performed at the pushbutton end of the lighter body. Such an alternative embodiment need not utilize the third arm member of the preferred embodiment but may have its actuator proportioned large enough so that it can be squeezed inwardly using the root portion of the index finger or adjacent portion of the palm of one hand while using the thumb of the same hand to depress the lighter's pushbutton. However, such an alternative embodiment would require its actuator to normally project further outwardly of the lighter's upper end portion (increasing bulkiness and notice) and, for acceptably comfortable adult usage, may have its actuator extending downwardly toward the main body portion, possibly adversely impacting producibility by existing facilities and making operation by children easier. Further, the outward projection and downward extension of such an actuator portion would effectively define a hook that becomes an annoyance when one attempts to drop the lighter into a pocket. On the other hand, such an alternative embodiment does have the significant advantage that the adult user cannot leave it lying about in an unlocked condition. It is therefore hereby expressly anticipated and included within the intended scope of the appended claims, but in view of the described limitations, such an alternative embodiment is not advocated and not illustrated in the accompanying drawings.

Fairbanks, et al., U.S. Pat. No. 5,002,482 (assignee BIC Corporation) discloses an effectively single-action device wherein a resilient stop member is mounted on the lighter's upper end portion under its pushbutton to normally block the pushbutton against depression, the stop member having an actuator portion thereof that projects outwardly of the lighter's upper end portion immediately adjacent its pushbutton and is movable arcuately sideways (by compression of a resilient portion of the stop member) and then upwardly so that it assumes a position in frictional engagement with an adjacent side of the pushbutton. When the pushbutton is depressed and then released the actuator moves downwardly and sideways back under the pushbutton. Multiple-step mode of operation is asserted on the basis that the actuator must be thus moved in two different directions. In point of fact the pushbutton is rendered depressible when the actuator is moved only sideways. A child need therefore move the actuator in only one direction and he will be able to depress the pushbutton, provided of course that the child is manually holding the actuator in such sideways moved position. The upward movement is provided for the convenience of the adult user. In order that the adult user can operate the lighter using only one hand he must remove his thumb from the actuator and apply it to the pushbutton for depression of it. This requires that the actuator be positively held in its sideways moved position. The upward movement and placement of the actuator adjacent the pushbutton serves that purpose.

Fujita, U.S. Pat. No. 5,074,781 (assignee Pollyflame Japan, Ltd.) is a single-action device wherein a rigid stop member is rotatably mounted on the lighter's upper end portion under its pushbutton and cooperates with a distinct coil spring that is mounted in compression under the stop member in an arrangement that eliminates the need for a child to manually hold the actuator sideways. In the Fujita improvement the coil spring impels the actuator upwardly to a pushbutton-unlocking position the moment the child pushes the actuator sideways. Fujita thereby offers a child-resistant lighter wherein the child does not have to hold the actuator sideways and does not have to push it upwardly—Fujita's improvement performs both functions for the child automatically.

Floriot, U.S. Pat. No. 5,090,893 (assignee Cricket) discloses several embodiments, some of which involve arcuate movement of an actuator and others of which involve straight-line movement of an actuator, but all of which are single-action devices. As in Fujita, in each the Floriot embodiments, when the actuator is moved in a single direction the actuator is positively held in its pushbutton-unlocking position by mechanical means until such time as the pushbutton is depressed and released.

As indicated above, the Standard seeks only to raise the level of child-resistancy from the 50% attained by the currently marketed product to 85% (which the CPSC has calculated to be only a 70% improvement), as opposed to requiring the industry to produce the most child-resistant lighter that it is technically possible to produce within the constraints of economy and adult convenience. In other words the Standard as presently written is "performance driven" and does not necessarily reflect the presently known state of the art (at least as evidenced by submissions (not including the patent next cited) by this inventor to the CPSC). So long as a given product meets the passively locking requirement and 85% qualification, it is marketable even though a product that might obtain a greater than 70% improvement could just as economically have been marketed having negligible adverse effect on consumer acceptance. In light of such permissiveness of the present Standard, an alternative embodiment of the invention pushbutton-locking spring is illustrated in the accompanying drawings having a single-action mode of operation competitive with that of the art described above.

Cirami, U.S. Pat. No. 4,830,603, is the only issued patent known to disclose a child-resistant lighter wherein the actuator portion of a pushbutton locking member must necessarily be moved in two different directions in order to render the lighter's pushbutton depressible. It discloses a U-shaped spring but of such size and arrangement as to adversely impact producibility of such a lighter. Such a U-shaped spring neither anticipates nor makes obvious the invention pushbutton-locking spring which has one portion thereof that is U-shaped and mounted in a recess that is restricted to the lighter's upper end portion and another portion thereof defining a stop member that is contiguous with a first arm member of the U-shaped portion and extends therefrom so as to be slidably mounted on the top wall of the lighter's upper end portion; neither does such patent suggest a mode of operation wherein by pushing an actuator formed at one end of the stop member, the stop member is moved from a given initial position to a given alternate position by forcing such first arm member to flex toward a second arm member of the U-shaped portion whereby the stop member is biased to return to its initial position.

The art discussed above is believed to be the closest and no more pertinent art is known to bear on the present subject matter.

SUMMARY OF THE INVENTION

An object of the invention is to make a given current lighter product child-resistant by modifications thereof restricted to the lighter's upper end portion and the underside of its pushbutton, such that the external size and shape of the main body portion of the lighter remains the same as that of the conventional product, current fuel capacity is retained, and only a single new element is added to the current lighter product, such new element being a pushbutton-locking spring that is insertable by machine into the upper end portion of the lighter.

Another object of the invention is to provide the upper end portion of a given current lighter product with a recess that is restricted to such upper end portion and is open at a top wall of such upper end portion under the lighter's pushbutton, to provide such spring having a first portion thereof that is U-shaped and mounted in such recess, to provide such U-shaped portion having first and second arm members contiguous with a bottom loop of such U-shaped portion that holds upper ends of such first and second arm members normally in spaced apart relationship with the upper end of the first arm member resiliently flexible toward the upper end of the second arm member, to provide such spring having a second portion thereof defining a stop member that is contiguous at one end with the upper end of such first arm member and extending therefrom so as to be slidably mountable on and being mounted on the top wall of the lighter's upper end portion, to provide such second portion having a free end normally projecting outwardly of such upper end portion and defining an actuator portion of such spring that is pushable toward the upper end portion against the resistance of such first arm member so as to cause the stop member portion of such spring to move from a given initial position to a given alternate position relative to a peg member provided depending from the lighter's pushbutton and having a free end normally in abutment with a first segment of such stop member whereby the pushbutton is normally blocked against depression, and to provide the stop member having a second segment thereof that is provided with a peg access opening through which such peg member is passable when the stop member is moved to such alternate position whereby the pushbutton is then depressible.

Another object of the invention is to provide a pushbutton-locking spring as described above but including a third arm member contiguous at one end thereof with the upper end of the second arm member and extending therefrom toward the second portion of such spring, to provide such third arm member having a free end adapted to engage such second portion when the stop member portion of such spring is located at its alternate position and to thereby positively hold the stop member at its alternate position, and to provide such third arm member when so engaged having a portion of its free end immediately adjacent the point of engagement located within the above-described peg access opening such that it is exposed to and is depressible by the peg member and is thereby disengaged from such second portion by the peg member when the pushbutton is depressed.

Another object of the invention is to provide a pushbutton-locking spring as described above but wherein the second portion of such spring is resiliently flexible relative to the upper end of the first arm member, and to provide an obstacle that prevents pushing the actuator portion directly toward the lighter's upper end portion but requires that the actuator be first be pushed upwardly by flexing such second portion relative to said first arm member in order to permit the actuator to override such obstacle.

Another object of the invention is to provide a pushbutton-locking spring as described above but wherein the obstacle referred to immediately above comprises an interference effected between the actuator and free end of the third arm member that prevents straight-inward movement of the actuator and requires the user to push the actuator first upwardly and to hold the actuator pushed upwardly, in order that the actuator will be positioned so as to override such interference, before the actuator can be pushed inwardly.

Finally, it is an object of the invention to provide a pushbutton-locking spring according to all the objects listed above in such form that it can be made as a plastic molding castable in a simple two-part molding die whereby it is economically producible by conventional means.

BRIEF DESCRIPTION OF THE DRAWINGS

FIG. 9 showing the actuator in the position it assumes when the user is holding it pushed upwardly while pushing it inwardly, FIG. 10 showing the actuator after the user has let go of the actuator, the actuator being then mechanically held at its inwardly moved position and FIG. 11 showing the pushbutton in its depressed position with its peg member depressing the third arm member of the invention pushbutton-locking spring and thereby disengaging it from the actuator, whereby, when the pushbutton is released, the actuator will return to its initial position.

DESCRIPTION OF PREFERRED EMBODIMENT

Figure 1:
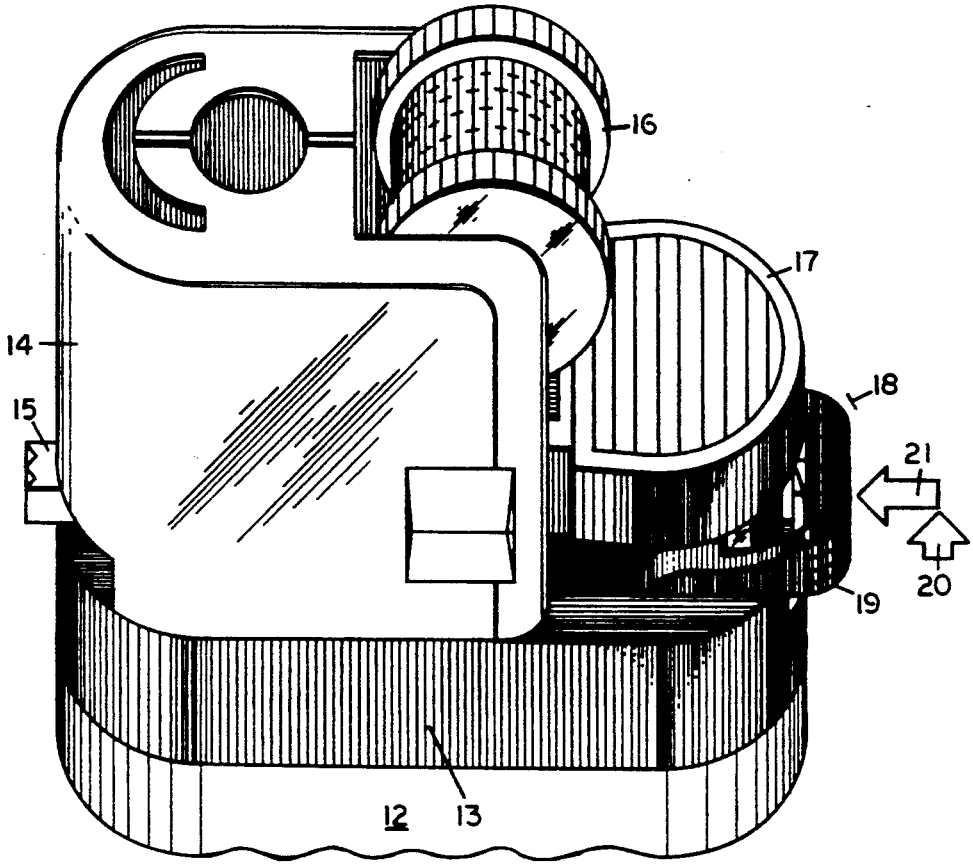
FIG. 1 is a general perspective view of the broken away upper part of a current disposable lighter product incorporating the preferred embodiment of the invention pushbutton-locking spring. The arrows indicate that the user must push a pushbutton-like actuator portion of such spring first upwardly (to overcome an obstacle) and then inwardly in order to move the stop member portion of such spring from the illustrated initial position to an alternate position that renders the pushbutton depressible.

Referring to FIG. 1, a disposable lighter product typical of that to which the invention is applicable includes a main body portion 12, an upper end portion 13, a windscreen 14, flame adjuster 15, flintwheel 16, and pushbutton 17.

The invention adds a pushbutton-locking spring indicated generally as 18 that is economically formed as a plastic casting using a suitably resilient material. The pushbutton-locking spring 18 is shaped so as to have a portion thereof defining an actuator 19 that normally projects outwardly of the upper end portion 13 and must be pushed first upwardly as indicated by arrow 20 and then, while holding the actuator 19 pushed upwardly, pushed inwardly as indicated by arrow 21, in order to move from the initial position shown in FIG. 1 wherein the pushbutton 17 cannot be depressed to an alternate position that permits the pushbutton 17 to be depressed.

Figure 2:
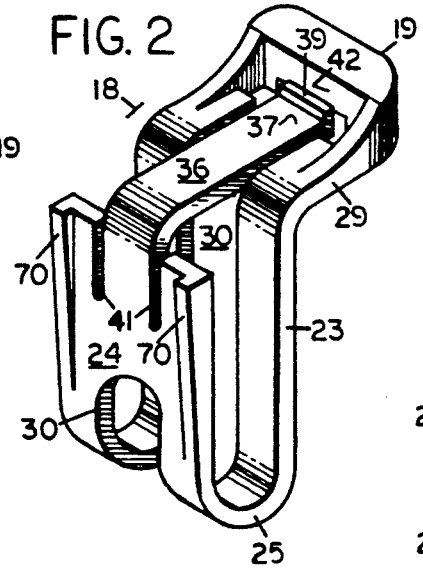
FIGS. 2 and 3 are perspective views of the invention pushbutton-locking spring per se showing it in the configuration it assumes after it has been inserted into the lighter and is in its initial position.
Figure 3:
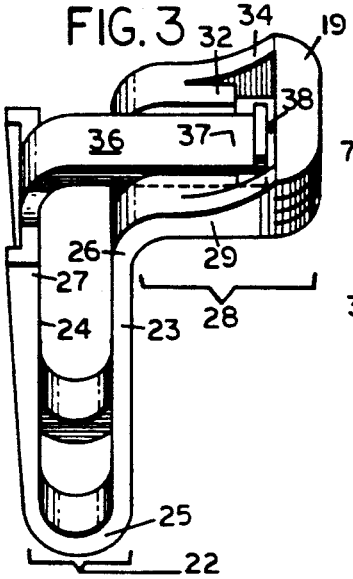
Figure 4:
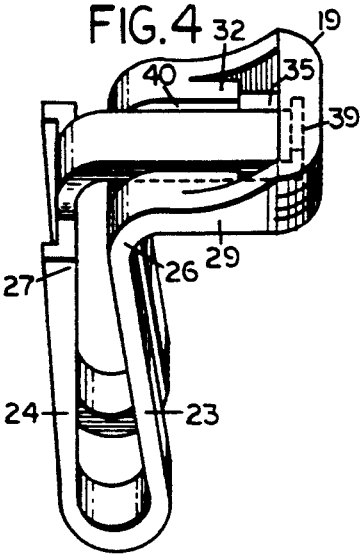
FIG. 4 is a perspective view of the invention pushbutton-locking spring showing it in the configuration it assumes after installation and when operated to its alternate position.

Referring simultaneously to FIGS. 2, 3 and 4, the invention pushbutton-locking spring 18 includes a first portion encompassed by the bracket 22 defining a U-shaped spring having a first arm member 23 and a second arm member 24 which are contiguous with a bottom loop 25 that holds the upper end 26 of the first arm member 23 normally spaced apart from the upper end 27 of the second arm member 24. The pushbutton-locking spring 18 is made of a plastic material having such resiliency that the upper end 26 of the first arm member 23 is flexible toward the upper end 27 of the second arm member 24 as shown in FIG. 4.

The pushbutton-locking spring 18 includes a second portion encompassed by the bracket 28 having one part thereof defining what is effectively a planar stop member 29 divided by a slot 30 and another part of the second portion 28 defining an actuator 19. The stop member 29 is contiguous at one end with the upper end 26 of the first arm member 23, extends therefrom so as to be slidably mountable on the top wall 31 (FIG. 5) of the lighter's upper end portion 13, and has the actuator 19 formed at its opposite end whereby pushing the actuator 19 forces the upper end 26 of the first arm member 23 to flex toward the upper end 27 of the second arm member 24 and thereby forces the stop member 29 to move (unless blocked) from the initial position show in FIGS. 2 and 3 to the alternate position shown in FIG. 4.

Figure 5:
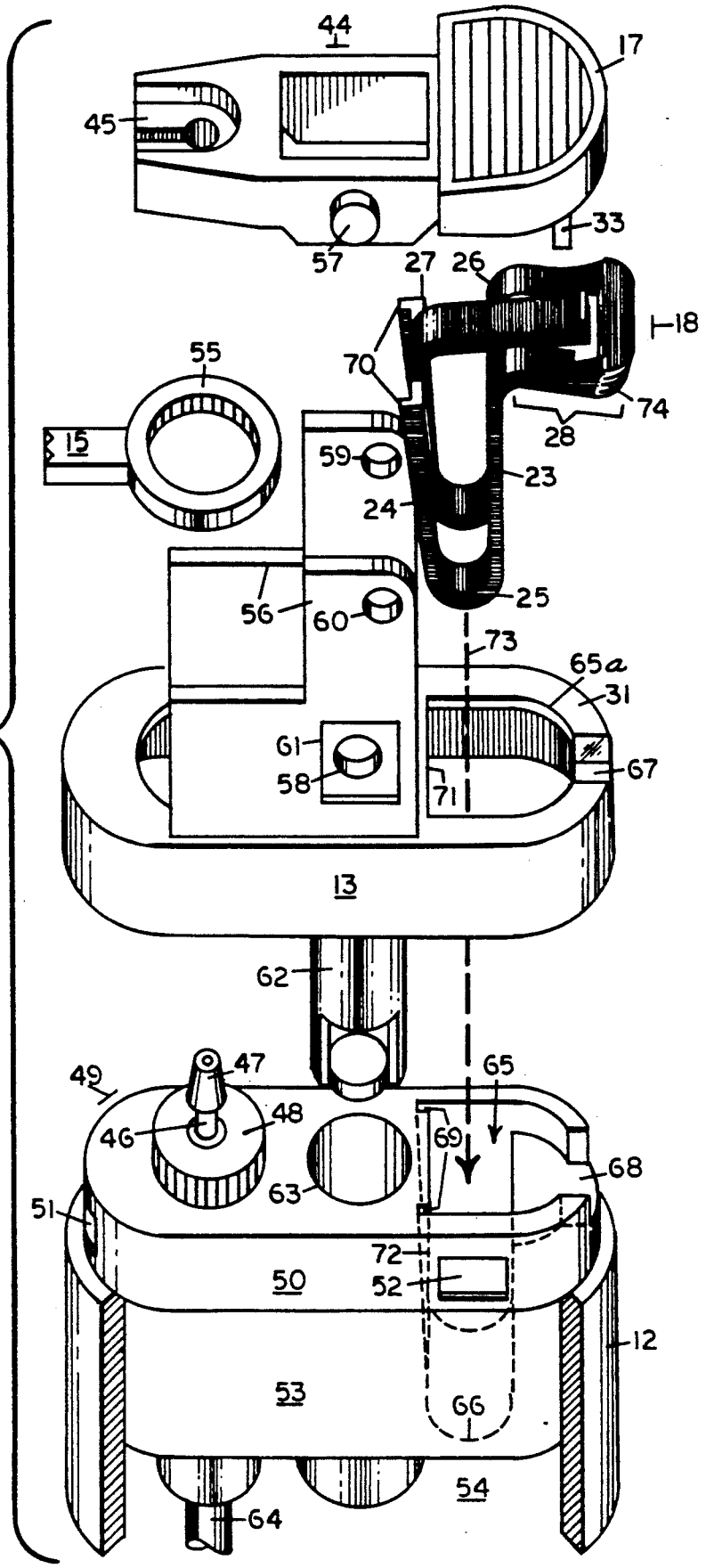
FIG. 5 is an exploded perspective view of certain components of the lighter of FIG. 1, including the invention pushbutton-locking spring, showing it in the configuration in which it is actually molded and in which it exists until inserted into the lighter, and showing the order of assembly.

The stop member 29 has a first segment 32, FIG. 3, located nearest the first arm member 23 that is adapted to block depression of the pushbutton 17 by interference with downward movability of a peg member 33, FIG. 5, that is provided depending from the underside of the pushbutton 17.

The stop member 29, FIG. 3, has a second segment 34 located between the first segment 32 and the actuator 19 that is provided with a peg access opening 35, FIG. 4, that is wide enough to permit passage of the peg member 33.

In the illustrated preferred embodiment the pushbutton-locking spring 18 includes a third arm member 36, FIG. 3, having one end thereof contiguous with the upper end 27 (disregarding the slots 41, FIG. 2) of the second arm member 24 and extending therefrom toward the second portion 28.

It will be obvious to those skilled in the art of casting plastic parts that the invention pushbutton-locking spring 18 is castable in a simple two-part molding die because of the slot 30 which extends from the second arm member 24, continues through the bottom loop 25 and first arm member 23 to the stop member 29 and ends short of the actuator 19; the slot 30 enabling one half of such molding die to access the underside of the third arm member 36 as well as all other lower and outer surfaces, while the other half of such molding die forms the upper side of the third arm member 36 as well as all other upper and inner surfaces.

The third arm member 36 has a free end 37 that extends through the stop member 29 by means of the slot 30. The third arm member 36 lies in the same plane as the stop member 29. The free end 37 of the third arm member 36 terminates short of the actuator 19 so that a clearance 38 is provided that enables the two halves of the molding die to close together and thereby form the third arm member 36 free of and flexible relative to the second portion 28. The extreme end of the free end 37 includes a ridge effecting a hook 39.

The slot 30 further provides a clearance 40, FIG. 4, along each longitudinally extending side of the third arm member 36 that is sufficient to enable the molding dies to form the third arm member 36 suspended free of the stop member 29; the free end 37 of the third arm member 36 being thereby depressible due to the resiliency inherent in the plastic material from which the pushbutton-locking spring is formed.

The pair of slots 41 serve to maximize the effective length of the third arm member 36 to enhance the flexibility of its free end 37.

In this preferred embodiment the hook 39 is square-ended to prevent the actuator 19 from being pushed directly inwardly (in the direction of the arrow 21 of FIG. 1). Unlike the above referenced Floriot embodiment wherein when the child has only to push the actuator inwardly and the pushbutton will be unlocked, in the instant preferred embodiment, if the actuator 19 is pushed inwardly, the lower edge of the inner surface 42, FIG. 2, of the actuator 19 will promptly abut the hook 39 and thereby stop movement of the actuator 19 into the inwardly moved position shown in FIG. 4.

In order to move the actuator 19 to the pushbutton-unlocking position shown in FIG. 4, the child would have to push the actuator 19 first upwardly (arrow 20, FIG. 1), in order to enable the lower edge of the inner surface 42 to override the hook 39, and then push the actuator 19 inwardly (arrow 21, FIG. 1). The upward movement is a very subtle one not easy for a child to notice when seeing the adult apply his thumb to the actuator 19.

Figure 6:
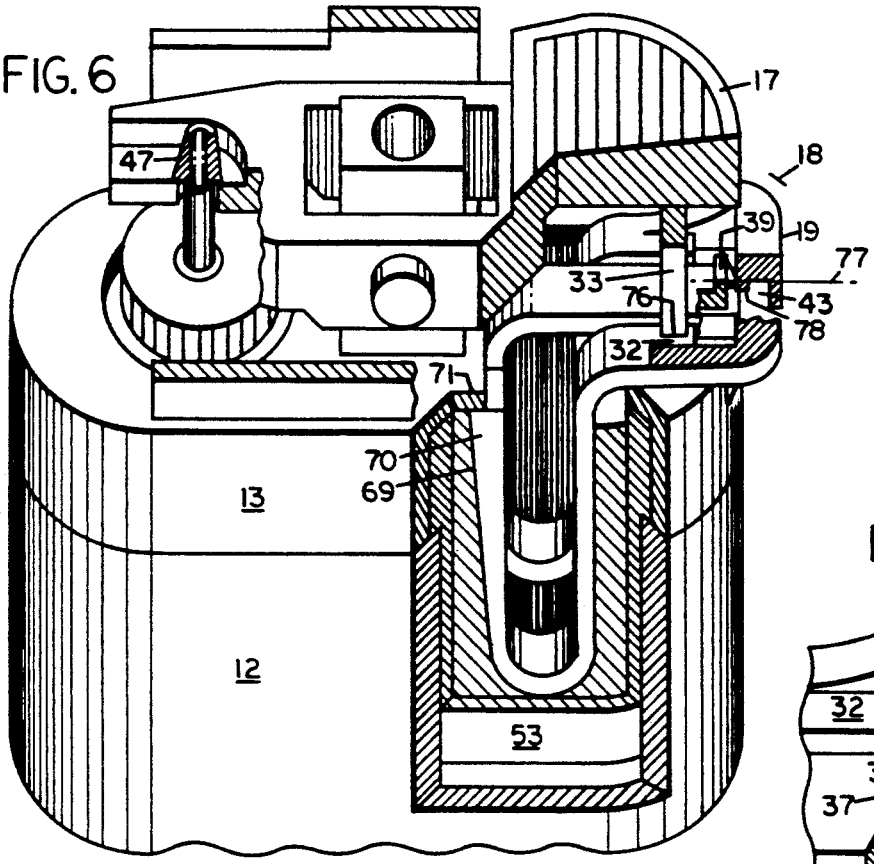
FIG. 6 is a perspective view partly in section and with approximately two-thirds of the lighter's main body portion broken away, showing the lighter's pushbutton and the invention pushbutton-locking spring in their respective initial positions.

When the actuator 19 is pushed first upwardly and then inwardly it overrides the hook 39 and permits a recess 43, FIG. 6, formed in the underside of the actuator 19 to engage the hook 39 whereby the actuator 19 is held in the position shown in FIG. 4 wherein the dashed-line rendition of the hook 39 indicates that the hook 39 is engaged in the recess 43 of FIG. 6.

The flexibility of the plastic material is such that the second portion 28 of the pushbutton-locking spring 18, which second portion 28 includes the actuator 19, is flexible relative to the upper end 26 of the first arm member 23, whereby the actuator 19 is liftable relative to the hook 39. The hook 39 does not follow such upward movement of the actuator 19 because the hook 39 is suspended free of the actuator 19, the hook 39 being carried by the third arm member 36 which, in turn, is supported only by the second arm member 24 which remains stationary at all times.

Referring now to FIG. 5, which depicts well-known components of such conventional lighter product, the pushbutton 17 forms the rearward end of a lever indicated generally as 44 having a split forward end 45 that is adapted to secure a snapped-on attachment around the neck portion 46 of a nozzle element 47 that is slidably mounted within a valve body 48 a lower portion of which (not shown) is screw-threaded into a plug indicated generally as 49 that forms an inner part of the upper end portion 13.

The upper end portion 13 secures a snapped-on attachment to an upper part 50 of the plug 49 by means of tabs (not shown) located on inner surfaces of the upper end portion 13 which engage recesses as at 51 and 52 which are formed on the upper part 50 of the plug 49.

A lower part 53 of the plug 49 is permanently secured in a fuel-tight manner in the main body portion 12 of the lighter body. For present purposes, the upper end portion 13 effectively has a much greater depth on the inside of the main body portion 12 than it has on the outside of the main body portion 12; this provides a place to mount the invention pushbutton-locking spring 18 without taking any space away from the fuel reservoir 54.

A lighter having the construction seen in FIG. 5, in effect, has its upper end portion 13 formed in two parts: an outer part comprising the structure 13, and an inner part comprising the plug 49. At least one alternative construction is known wherein the upper end portion 13 and plug 49 are formed in one piece. The construction seen in FIG. 5 was selected for illustration because in widest use. For purposes of the present improvement, it is immaterial whether the upper end portion 13 is formed in two parts or in one piece. In the appended claims the term "upper end portion" shall be understood to mean the upper end portion 13 inclusive of the plug 49, whether or not the upper end portion 13 and plug 49 are formed as separate pieces or are form in one piece. For present purposes there is no functional distinction therebetween: the plug 49 is effectively merely an inner part of the upper end portion 13.

Continuing with the description of the conventional components of the FIG. 5 lighter construction, the flame adjuster 15 has a ring-shaped portion 55 thereof having internal teeth that engage corresponding external teeth formed on the valve body 48 whereby the user can adjust flame height by adjusting the tightness of the threaded fit of the valve body 48 in the plug 49. The upper end portion 13 includes a pair of parallel spaced apart tabs 56 between which the lever 44 is pivotally mounted by means of an opposed pair of teats one of which is seen at 57, which are snapped into a corresponding opposed pair of openings one of which is seen at 58. The flintwheel (FIG. 1) is rotatably mounted in the same manner as the lever 44, utilizing the opposed pair of openings seen at 59 and 60, FIG. 5. The indentation at 61, together with a similar one on the unseen side of the opposite tab 56, enables the windscreen 14, FIG. 1, to secure a snapped-on attachment to the upper end portion 13. A flint (not shown) and a flint-biasing spring (not shown) is mounted in a tubular structure 62 that is received in a recess 63 provided in the plug 49 portion of the upper end portion 13. The tubular structure seen at 64 is a broken away portion of a fuel intake tube that is conventionally provided communicating with the valve body 48 for supplying fuel thereto from the fuel reservoir 54, the fuel reservoir 54 being defined by the main body portion 12 a closed at its upper end by the lower part 53 of the plug 49 and at its lower end by a portion of the main body portion 12 that in FIG. 5 has been sectioned away.

The invention pushbutton-locking spring requires modification of such conventional structure only as follows.

The pushbutton 17 is provided with a depending peg member 33.

Stated first in general terms for purposes of supporting the language relied upon in the appended claims wherein the term "upper end portion" is intended to include the inner or plug 49 part of the upper end portion 13: the upper end portion of the current lighter product is provided with a recess that is open at the top wall of such upper end portion under the lighter's pushbutton, extends into the inner part of such upper end portion and terminates short of the fuel reservoir.

Restating the preceding sentence in terms specific to the particular two-part construction of the current lighter product illustrated in FIG. 5, the top wall 31 of the upper end portion 13 is provided an opening 65*a* that defines the open end of a recess 65 that is provided in the plug 49, the recess 65 extending into the plug 49 and terminating short of the reservoir 54 as indicated by the dashed lines at 66.

The molding die conventionally used to form the upper end portion 13 is modified to provide a notch 67 (to provide clearance for depression of the free end 37 of the third arm member 36).

The molding die conventionally used to form the inner part or plug 49 of the upper end portion 13 is modified to form the recess 65 inclusive of a notch 68 that cooperates with the notch 67 of the upper end portion 13 to effect the clearance referred to immediately above.

The recess 65 includes a pair of grooves 69 which receive a pair of tapered tabs 70 formed on the outer margins of the second arm member 24 of the pushbutton-locking spring 18.

The upper end portion 13 is snapped onto the plug 49 according to conventional practice. After such installation, the edge 71 of the upper end portion 13 will extend across both grooves 69; i.e., the edge 71 will then be substantially flush with the wall 72 of the recess 65.

In the case of that alternative construction of current lighter product mentioned above wherein an outer part functionally equivalent to the instant upper end portion 13 and an inner part functionally equivalent to the instant plug 49 are formed all in one piece, the grooves 69 may be formed as "undercuts" whereby a portion of the recess 65 wall is left closing the upper end of each groove 69 so as to be functionally equivalent to the edge 71—such solution, of course, requiring a relatively complex molding die.

The flame adjuster 15 and flint (not shown) with underlying upwardly biasing spring (not shown) are next pressed into their respective mounting positions in the conventional manner and, at this phase of the order of assembly, the pushbutton-locking spring 18 is inserted into the upper end portion 13 as indicated by the arrow 73.

Notice that, before insertion, the upper end 27 of the second arm member 24 diverges from the upper end 26 of the first arm member 23. During insertion, the edge 71 forces the upper end 27 of the second arm member 24 to flex toward the upper end 26 of the first arm member 23 because of the taper of the tabs 70. When the pushbutton-locking spring 18 is fully inserted within the recess 65, the tabs 70 (impelled by the return bias of the upper end 27) enter into the grooves 69 whereby the tabs 70 are then located under the edge 71. The pushbutton-locking spring 18 is thereby positively secured in and cannot be withdrawn from the recess 65. After such insertion, the first and second arm members 23, 24, respectively, of the pushbutton-locking spring 18 will be in partial compression between the corresponding opposed walls of the recess 65 and for that reason as well as due to the recess 65 being substantially deeper than it is wide, the whole of the U-shaped first portion 22 will remain firmly secured in the recess 65 even when the first arm member 23 is later flexed as shown in FIG. 4.

Notice also that, before insertion into the lighter, the second portion 28 forms an acute angle with respect to the first arm member 23. The pushbutton-locking spring 18 is forcibly inserted into the upper end portion 13 (snapped into place), causing the second portion 28 to flex upwardly into a final 90 degree angle relative to the first arm member 23. As a result of such flexure effected during insertion, the second portion 28 will always be biased to seat positively on the top wall 31 of the upper end portion 13. This feature is important in the following respects.

First, it has the effect of compensating for the arcuate movement of the upper end 26 of the first arm member 23 when the upper end 26 is flexed toward the upper end 27 of the second arm member 24; such that, when the stop member 29 is moved from its initial position to its alternate position, the actuator 19 will not be lifted by such arcuate movement but will instead stay flat on the top wall 31 and always be biased to resist movement away from the top wall 31.

Second, it effectively provides a draft allowance that permits the molding of parallel grooves 74 extending laterally across the outer surface of the actuator 19 for obtaining a comfortable grip on the actuator 19 without the provision of such grooves interfering with the ease of ejection of the part from the molding die.

A further advantage resulting from molding the pushbutton-locking spring 18 in an initially expanded configuration is that, referring back to FIG. 3, the minimal clearance 38 desired between the hook 39 and the inner surface 42 of the actuator 19 can be obtained without requiring the molding die to be made excessively thin at that point because when in the initially expanded configuration (as shown in FIG. 5) the hook 3 and inner surface 42 are not close together (as shown in FIG. 3) but are initially substantially further apart. It is only when finally pressed into the lighter that the hook 39 and inner surface 42 are brought into close proximity. Accordingly, the desired minimal clearance therebetween is readily obtainable when finally assembled into the lighter; at which time it will be possible to push the actuator 19 inwardly only slightly before it will be stopped by the hook 39.

The lever 44 follows the pushbutton-locking spring 18 onto the upper end portion 13 and the assembly is completed by installation of the flintwheel 16 and windscreen 14 according to current practice.

To this point it has been shown that: (i) the pushbutton-locking spring 18 is itself economically producible because formable as a molded plastic part, (ii) little modification of the current lighter product is required to prepare it for installation of the pushbutton-locking spring 18, (iii) such modification can be effected at minimum cost by alteration of existing molding dies (as opposed to requiring wholly new ones) and (iv) assembly is irreducibly simple since it involves only a single straight insertion in the manner of the other components of the lighter and is likewise performable by machine at high speed. The mode of operation is next described.

Referring to FIG. 6 (which shows the lighter as assembled but only with those conventional components pertinent to the invention), the upper end portion 13, main body portion 12 and plug 49 are shown partly in section, revealing the U-shaped first portion of the pushbutton-locking spring 18 mounted in the recess 65 (for numbers not appearing on FIG. 6 please refer to FIG. 5). FIG. 6 shows one of the tapered tabs 70 seated in its groove 69 and secured under the edge 71 of the upper end portion 13. In FIG. 6 the pushbutton-locking spring 18 and the pushbutton 17 are in their initial position. The peg member 33 is shaped like a thin wall; meaning that, it is very narrow as seen in this side view of the lighter but, if it were rotated 90 degrees, the peg member 33 would be seen to have such width that its free end 76 extends across and beyond both side edges of the third arm member 36 so that the peg member 33 normally stands upon the adjacent corresponding portions of the first segment 32 of the stop member 29.

The stop member 29 itself, of course, rests positively upon the top wall 31 and therefore effects a firm foundation that prevents the peg member 33 from being pushed downwardly any further by the pushbutton 17. The nozzle 47 is in its normally closed position. It cannot at this time be operated to its open position because the pushbutton 17 cannot be depressed due to the peg member being in abutment with the first segment 32 of the stop member 29. Accordingly, FIG. 6 shows the pushbutton-locking spring 18 in a given initial position that blocks depression of the pushbutton 17. In such initial position, the actuator 19 projects outwardly of the upper end portion 13. In FIG. 6, the actuator 19 and the hook 39 have been sectioned on a common plane of symmetry and an axis 77 has been superimposed upon them so that we can see their relative initial position.

As earlier mentioned, the actuator 19 has a recess 43 formed in its underside. The axis 77 in FIG. 6 shows that the hook 39 extends upwardly just high enough to normally block pushing the actuator 19 directly inwardly as indicated by arrow 21 in FIG. 1. If the child attempts to do so, the portion 78 (previously referred to as the lower edge of inner surface 42) of the actuator 19 will abut the hook 39. The portion 78 must first be lifted to the elevation of the axis 77 before the actuator 19 can be pushed inwardly. This imposes a double-action mode of operation which cannot be avoided by a child even if the child is using both hands, and such added measure of safety is obtained without the slightest increase in cost and with negligible added inconvenience to adults.

Figure 7:
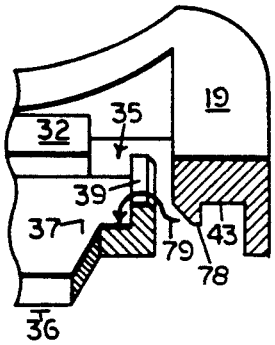
FIG. 7 is a detail perspective view partly in section showing the pertinent portions of the invention pushbutton-locking spring in an alternative single-action form.

FIG. 7 shows a single-action alternative.

In FIG. 7, the pertinent area of the actuator 19 and hook 39 are shown enlarged and sectioned as in FIG. 6 but with the near half of the actuator 19 broken away in entirety. In this alternative embodiment, the hook 39 and portion 78 of the actuator 19 are beveled instead of being squarely opposed, and as a result, when the actuator 19 of FIG. 7 is pushed directly inwardly it will not be stopped by interference between the portion 78 and the hook 39. Instead, the portion 78 will bounce over the hook 39 in the manner indicated by the curved arrow 79. The hook 39 will thereby enter immediately into the recess 43 and hold the actuator 19 in its inwardly moved position. The FIG. 7 alternative thereby permits the pushbutton 17 to be rendered depressible when the actuator 19 is pushed in only a single direction.

Figure 8:
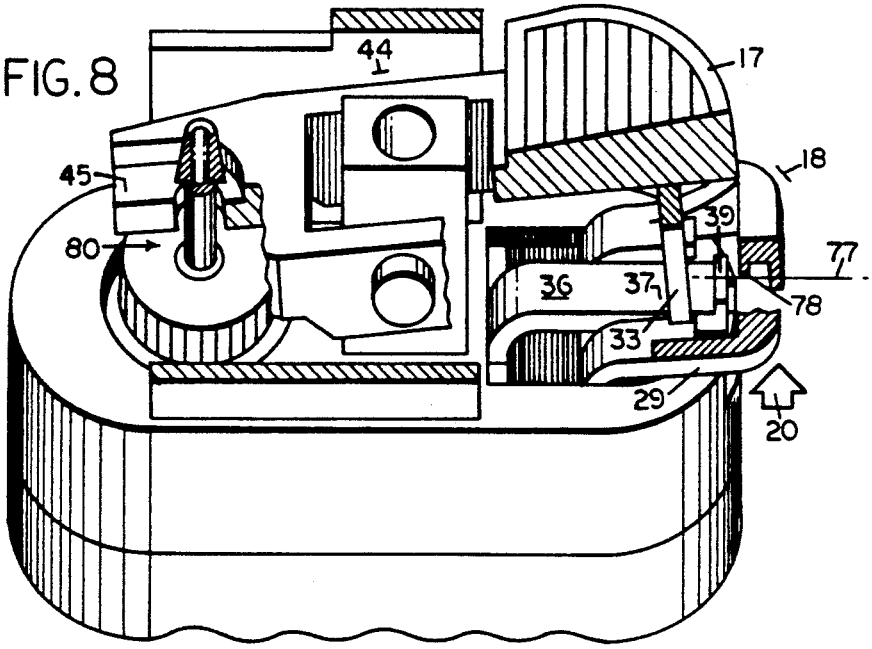
FIG. 8 is a perspective view similar to FIG. 6 of the preferred embodiment with more of the main body portion broken away but showing the invention pushbutton-locking spring and the pushbutton in the respective positions assumed when the actuator has been pushed upwardly and before it has been pushed inwardly.

Returning to the description of the preferred double-action embodiment, FIG. 8 shows the actuator 19 in upwardly pushed position as though a user's thumb were holding it pushed upwardly in the direction of the arrow 20. The portion 78 of the actuator 19 is now above the elevation of the axis 77 and the actuator 19 can therefore at this time be pushed inwardly. The upward flexibility of the stop member 29 relative to the first arm member 23 permits the actuator 19 to be pushed upwardly. FIG. 8 shows the stop member 29 and actuator 19 upwardly inclined and pushing the pushbutton 17 upwardly while the free end 37 of the third arm member remains at its normal elevation. In current lighter products of the construction illustrated, there is a clearance 80 under the forward end 45 of the lever 44 that permits a sufficient downward movement of its forward end 45, with corresponding upward movement of the pushbutton 17, as to enable the actuator 19 to be pushed upward as described. There is no effect on valve closure when the pushbutton 17 is pushed upwardly.

Figure 9:
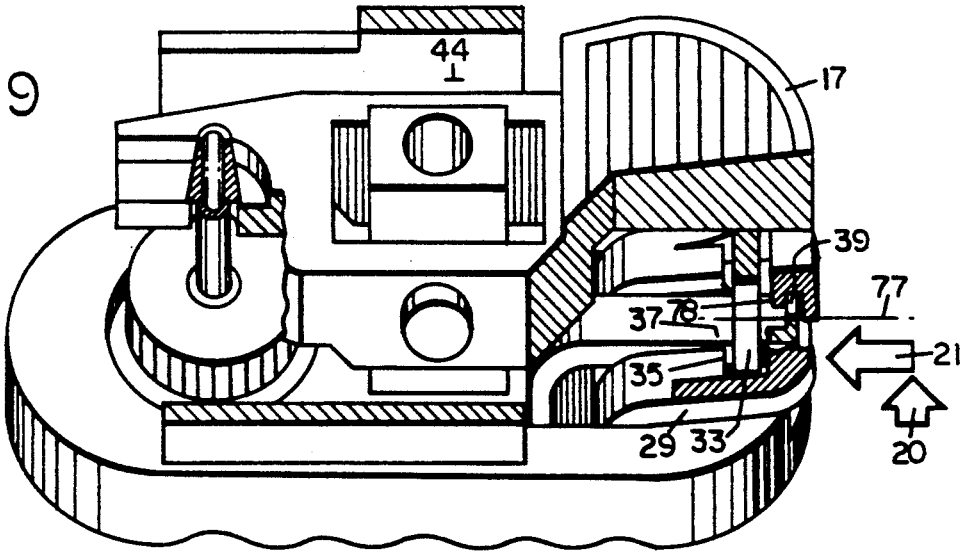
FIGS. 9, 10 and 11 are similar perspective views partly in section with all of the main body portion and some of the upper end portion of the lighter broken away.

FIG. 9 shows the actuator 19 in its inwardly pushed position just before the user has let go of the actuator 19 whereby it and the stop member 29 are still upwardly inclined. Note the elevation and position of the portion 78 of the actuator 19 relative to the axis 77 at this time whereby the recess 43 (not numbered in this figure) is correctly positioned to fall into engagement with the hook 39. Note also that the pushbutton 17 is no longer upwardly inclined, the reason being that the peg access opening 35 has now been brought into a position located directly under the peg member 33 and as a result the peg member 33 is no longer being pushed upwardly but now stands upon the free end 37 of the third arm member 36.

Figure 10:
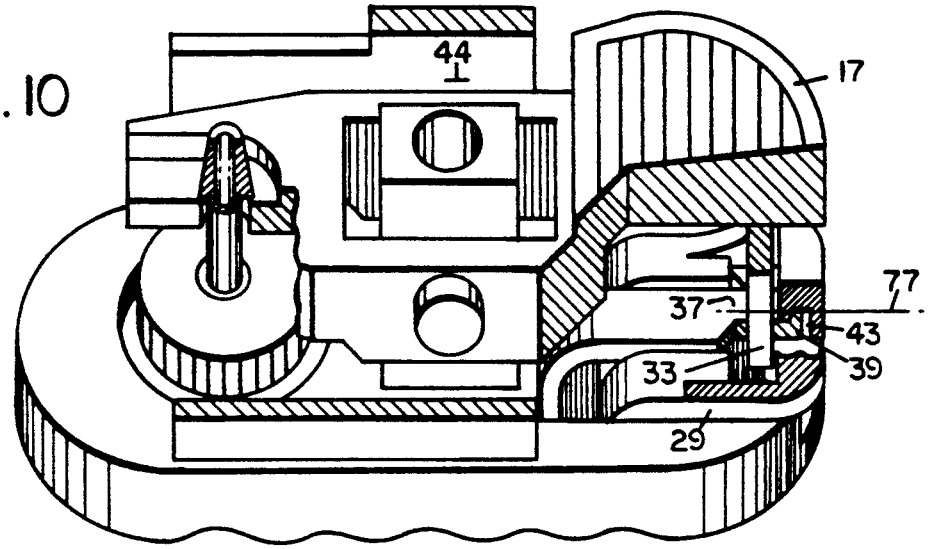

FIG. 10 represents the actuator 19 having been released by the user's thumb which has allowed the recess 43 of the actuator 19 to fall into engagement with the hook 39, the actuator 19 having moved downwardly in response to its normal bias (acquired during installation) plus the additional bias acquired when the actuator 19 was pushed upwardly. The stop member 29 is now positively held in its alternate position and the user is free to apply his thumb to the pushbutton 17 for depression of it.

Figure 11:
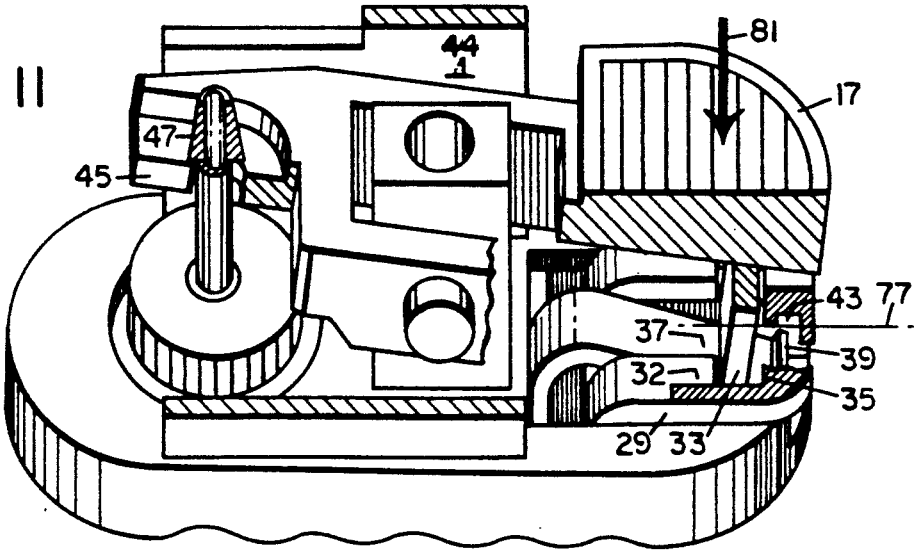

FIG. 11 shows the pushbutton 17 having been depressed by thumb pressure applied in the direction indicated by arrow 81 whereby the forward end 45 of the lever 44 has been caused to lift the nozzle 47 into its fuel-releasing open position. Depression of the pushbutton 17 was made possible by passage of the peg member 33 through the peg access opening 35. When so depressed the peg member 33 pushes the free end 37 of the third arm member 36 downwardly, thereby disengaging the hook 39 from the recess 43 and freeing the actuator 19, whereby, when the pushbutton 17 is released and returned to its normal elevation, the actuator 19 will spring back to its initial position wherein the first segment 32 will again be located under the peg member 33 and the pushbutton 17 will thereby automatically be returned to its normally locked condition.

Finally, if desired, the lower or free end of the peg member 33 may be formed having a curved or beveled edge instead of being square as shown whereby the adjacent edge of the first segment 32 will positively drive the peg member 33 upwardly when the pushbutton is released.

I claim:

1. A child-resistant lighter, including:

a main body portion defining a reservoir for containment of a combustible fluid under pressure, an upper end portion mounted on said main body portion, valve means mounted on said upper end portion communicating with said reservoir for release of said fluid in a gaseous state, said valve means being in a normally closed position that prevents release of said fluid from said reservoir, a valve actuating lever pivotally mounted on said upper end portion, said upper end portion including a top wall, said lever having one end thereof defining a thumb-depressible pushbutton that is normally spaced apart from said top wall and having an opposite end thereof engaged with said valve means for operation of said valve means to an open position that releases said fluid from said reservoir, said valve means being operated to said open position in response to depression of said pushbutton toward said top wall, means biasing said pushbutton to return to said position normally spaced apart from said top wall, and, means operable substantially simultaneously with depression of said pushbutton producing a spark for igniting said fluid;

wherein the improvement comprises:

said pushbutton provided with a depending peg member having a free end proximate said top wall;

said upper end portion provided with a recess open at said top wall and terminating short of said reservoir;

a pushbutton-locking spring having a first portion secured in said recess and a second portion slidably mounted on said top wall;

said first portion of said spring comprising first and second arm members having upper and lower ends, the lower ends of said first and second arm members being contiguous with a bottom loop that holds the upper ends of said first and second arm members normally spaced apart, the upper end of said first arm member being resiliently flexible toward the upper end of said second arm member;

said second portion of said spring having one part thereof defining a stop member that is contiguous at one end thereof with the upper end of said first arm member and extending therefrom so as to be slidable on said top wall under the free end of said peg member;

said stop member having a given initial position on said top wall relative to the free end of said peg member;

said second portion of said spring having another part thereof defining an actuator that, when said stop member is in said initial position, projects outwardly of said upper end portion and is pushable toward said upper end portion to slide said stop member from said initial position to a given alternate position on said top wall relative to the free end of said peg member by causing the upper end of said first arm member to flex toward the upper end of said second arm member whereby said stop member and said actuator are biased by said first arm member to return to said initial position;

said stop member having adjacent first and second segments, said first segment being located nearest said first arm member, said second segment being located nearest said actuator;

said first segment being adapted to block movement of the free end of said peg member toward said top wall by depression of said pushbutton;

when said stop member is in said initial position the free end of said peg member being in abutment with said first segment, said pushbutton being thereby normally blocked against depression and said valve means being thereby normally not operable to said open position;

said second segment of said stop member being provided with a peg access opening through which the free end of said peg member is passable;

when said stop member is in said alternate position said peg access opening being under the free end of said peg member, said pushbutton being thereby depressible by entry of the free end of said peg member into said peg access opening and said valve means being thereby operable to said open position.

2. A child-resistant lighter as recited in claim 1:

wherein by depressing said pushbutton said peg member is depressible in a given plane toward said top wall;

wherein said pushbutton-locking spring includes a third arm member that has one end thereof contiguous with the upper end of said second arm member;

wherein said first arm member is provided with an opening through which said third arm member is extendible, said third arm member extends past said first arm member through said last-recited opening and has a free end that reaches said second portion of said spring;

wherein said free end of said third arm member is resiliently flexible relative to said second arm member such that the free end of said third arm member is depressible in said plane;

wherein when said stop member is in said initial position said first segment of said stop member blocks depression of the free end of said third arm member by said peg member;

wherein means is provided effecting an engagement between the free end of said third arm member and said second portion of said spring when said stop member is located in said alternate position, so arranged that, said stop member is thereby held in said alternate position but said second portion is released from the free end of said third arm member when the free end of said third arm member is depressed;

wherein when said stop member is in said alternate position the free end of said third arm member is located within said peg access opening and is thereby depressible by said peg member; and, wherein when said pushbutton is depressed, said peg member depresses the free end of said third arm member and thereby disengages the free end of said third arm member from said second portion.

3. A child-resistant lighter as recited in claim 2:

wherein said second portion of said spring is resiliently flexible relative to the upper end of said first arm member in said plane so that said actuator is thereby movable in a direction away from said top wall; and, wherein means is provided defining an obstacle that blocks movement of said actuator in a straight line directly inwardly toward said upper end portion far enough to effect movement of said stop member from said initial position to said alternate position, so constructed and arranged that said obstacle is overridden by movement of said actuator in said direction away from said top wall.

4. For use to effect child-resistancy in a disposable lighter, a pushbutton-locking spring formed in one piece, made of a material having resiliency suitable to effect a spring and having a form suitable for casting in a two-part molding die, said pushbutton-locking spring comprising:

a one-piece member substantially defining a leaf spring having a first portion, a second portion and a third portion;

said first portion of said spring being U-shaped and comprising first and second arm members having upper and lower ends, the lower ends of said first and second arm members being contiguous with a bottom loop that holds the upper ends of said first and second arm members normally spaced apart, the upper end of said first arm member being resiliently flexible toward the upper end of said second arm member;

said second portion of said spring having one part thereof defining a stop member that is contiguous at one end thereof with the upper end of said first arm member and extending laterally therefrom and having another part thereof defining an actuator that is pushable toward said U-shaped first portion by causing the upper end of said first arm member to flex toward the upper end of said second arm member whereby said stop member and said actuator are biased by said first arm member to return to their initial position;

said stop member having adjacent first and second segments, said first segment being located nearest said first arm member, said second segment being located nearest said actuator;

said first arm member, bottom loop, second arm member and stop member provided with an elongate, common, continuous, double-blind slot of given substantially uniform width that is centered on a plane of symmetry of said spring and extends from a point on said second arm member near said bottom loop, continues through said bottom loop, said first arm member and said stop member and terminates adjacent said actuator;

said first segment of said stop member defining a pair of planar surfaces which border opposed sides of said slot;

said second segment of said stop member provided with an opening having a width as measured in a direction crosswise to said plane of symmetry that is greater than the width of said slot;

said third portion of said spring comprising a third arm member having a width less than the width of said slot, having one end contiguous with the upper end of said second arm member, extending laterally from said second arm member centered on said plane of symmetry so as to be at all points thereon centered over said slot, continuing past said first arm member to said stop member and having a free end proximate but terminating short of said actuator;

said free end of said third arm member defining a hook adapted to enter into a recess provided in said actuator and thereby engage and hold said actuator when said actuator is pushed toward said U-shaped first portion, the arrangement being such that, flexure of the free end of said third arm member toward said bottom loop disengages the free end of said third arm member from said actuator.

* * * * *